US005236042A

United States Patent [19]

Kado

[11] Patent Number: 5,236,042

[45] Date of Patent: Aug. 17, 1993

[54] HEAT EXCHANGER AND METHOD OF MAKING THE SAME

[75] Inventor: Hirotaka Kado, Isesaki, Japan

[73] Assignee: Sanden Corporation, Gunma, Japan

[21] Appl. No.: 837,928

[22] Filed: Feb. 20, 1992

[30] Foreign Application Priority Data

Feb. 20, 1991 [JP] Japan ..... 3-026473

[51] Int. Cl.[5] ..... F28F 9/26

[52] U.S. Cl. ..... 165/149; 165/173; 29/890.052

[58] Field of Search ..... 165/67, 149, 173; 29/890.052

[56] References Cited

U.S. PATENT DOCUMENTS 3,866,675 2/1975 Bardon et al. ..... 165/173
3,993,126 11/1976 Taylor ..... 165/173
4,569,390 2/1986 Knowlton et al. ..... 165/149
4,938,284 7/1990 Howells ..... 165/149
5,107,926 4/1992 Calleson ..... 165/173
5,127,466 7/1992 Ando ..... 165/67

*Primary Examiner*—Allen J. Flanigan
*Attorney, Agent, or Firm*—Baker & Botts

[57] ABSTRACT

A heat exchanger which includes a pair of substantially parallel header pipes. A plurality of substantially parallel tubes are disposed between the pair of header pipes. Each tube defines a pair of end portions which are connected to the pair of header pipes. Each of the pair of header pipes comprises a rectangular member which has a longitudinal opening formed along one side of the rectangular member. A connecting plate is installed in the opening. The connecting plate has a plurality of holes for receiving the end portions of the tubes therein to connect the tubes to each of the pair of header pipes. According to the above structure, a heat exchanger can be easily manufactured and inexpensively produced by reducing the cost for manufacturing the header pipes. The construction of the present heat exchanger reduces the occurrence of defects in the connection of tubes.

24 Claims, 6 Drawing Sheets

HEAT EXCHANGER AND METHOD OF MAKING THE SAME

TECHNICAL FIELD

The present invention relates to a heat exchanger for use preferably as a condenser and a radiator of an air conditioner for a vehicle, etc.

BACKGROUND OF THE INVENTION

FIGS. 1 and 2 show a conventional heat exchanger which operates to exchange heat between a heat medium (for example, a cooling medium or a brine) flowing in the heat exchanger and air passing through the heat exchanger. A heat exchanger 21, as shown in FIG. 1, is comprised of a pair of header pipes 22 extending in parallel relation to each other, a plurality of tubes 23 disposed between the header pipes and connected to the header pipes at their end portions, a plurality of radiation fins 24 provided on the sides of the tubes, a pair of reinforcement members 25 disposed on the top and bottom radiation fins, and brackets 26 for supporting the heat exchanger which are attached to the upper and lower portions of each header pipe.

Each header pipe 22 is constructed from a straight pipe having a circular cross section. A plurality of connection holes 27 are formed on the periphery of the header pipe with a predetermined pitch in the axial direction of the header pipe. The end portion of each tube 23 is inserted into a corresponding connection hole 27. Both ends of each header pipe 22 are closed by caps 28. An inlet tube 29 for introducing the heat medium into heat exchanger 21 is connected to one of the header pipes 22, and an outlet tube 30 for discharging the heat medium out of heat exchanger 21 is connected to the other header pipe.

Each tube 23 is formed as a straight tube which is flattened in the horizontal direction. The end portions of tubes 23 are each inserted into a connection hole 27 of a header pipe 22, and fixed therein by, for example, brazing. Corrugated type radiation fins 24 are fixed on the upper and lower surfaces of each tube 23 by brazing.

Brackets 26 are provided for attaching the heat exchanger to an air conditioner structure or a body of a vehicle. Each bracket 26 has a U-shaped slot 31 defined in its end portion. A bolt or the like is inserted through the slot to attach the heat exchanger to the appropriate structure. Brackets 26 are fixed to header pipes 22 by brazing the curved portions of the brackets on the peripheries of the header pipes.

However, since connection holes 27 in such a conventional heat exchanger are formed on the periphery of header pipe 22 having a circular cross section, a special jig or tool is required for processing the holes. This operation causes the manufacturing of the header pipe to be expensive. Therefore, it is difficult to produce the heat exchanger inexpensively. In addition, defects are liable to occur while inserting and connecting tubes 23 into the header pipes, because it is difficult to form connection holes 27 at precise positions and with desired shapes.

Moreover, since brackets 26 for supporting the heat exchanger are welded or brazed directly onto the peripheries of header pipes 22, the shape of the brackets must be formed to correspond to the shape of the header pipes. Accordingly, the manufactured brackets are essentially restricted to one shape. Furthermore, the welding or brazing of the brackets 26 onto the peripheries of header pipes 22 is troublesome and causes the bracket attachment process to be inefficient.

Furthermore, since tube 23 is connected to header pipe 22 only at connection hole 27, tube 23 may be moved in the lateral direction of header pipe 22 by a relatively weak force. Accordingly, the whole shape of heat exchanger 21 may be deformed by a relatively weak force.

In addition, reinforcement member 25 disposed on the surface of radiation fin 24 can not be securely connected to header pipes 22 because the outer peripheral surface of header pipe 22 is curved. It does not thus sufficiently improve the overall strength of heat exchanger 21.

SUMMARY OF THE INVENTION

It is an object of this invention to provide a heat exchanger which can be inexpensively produced by reducing the cost for manufacturing the header pipes and reducing the occurence of defects in the connection of tubes.

It is another object of this invention to provide a heat exchanger in which the working efficiency of the bracket attachment process in the assembly is increased.

It is another object of this invention to provide a heat exchanger in which the overall strength of the structure is efficiently improved.

A heat exchanger according to the present invention includes a pair of substantially parallel header pipes. A plurality of substantially parallel tubes are disposed between the pair of header pipes. Each tube defines a pair of end portions which are connected to the pair header pipes. Each of the header pipes comprises a rectangular member. The rectangular member has an opening which extends in the longitudinal direction along one side of the rectangular member. A connecting plate is installed in the opening and has a plurality of holes to facilitate the insertion of the end portions of the tubes therein to connect the tubes to each of the pair of header pipes.

Further objects, features and other aspects of this invention will be understood from the following detailed description of the preferred embodiments of this invention with reference to the attached drawings.

DETAILED DESCRIPTION OF THE PREFERRED EMBODIMENTS

Figure 1:
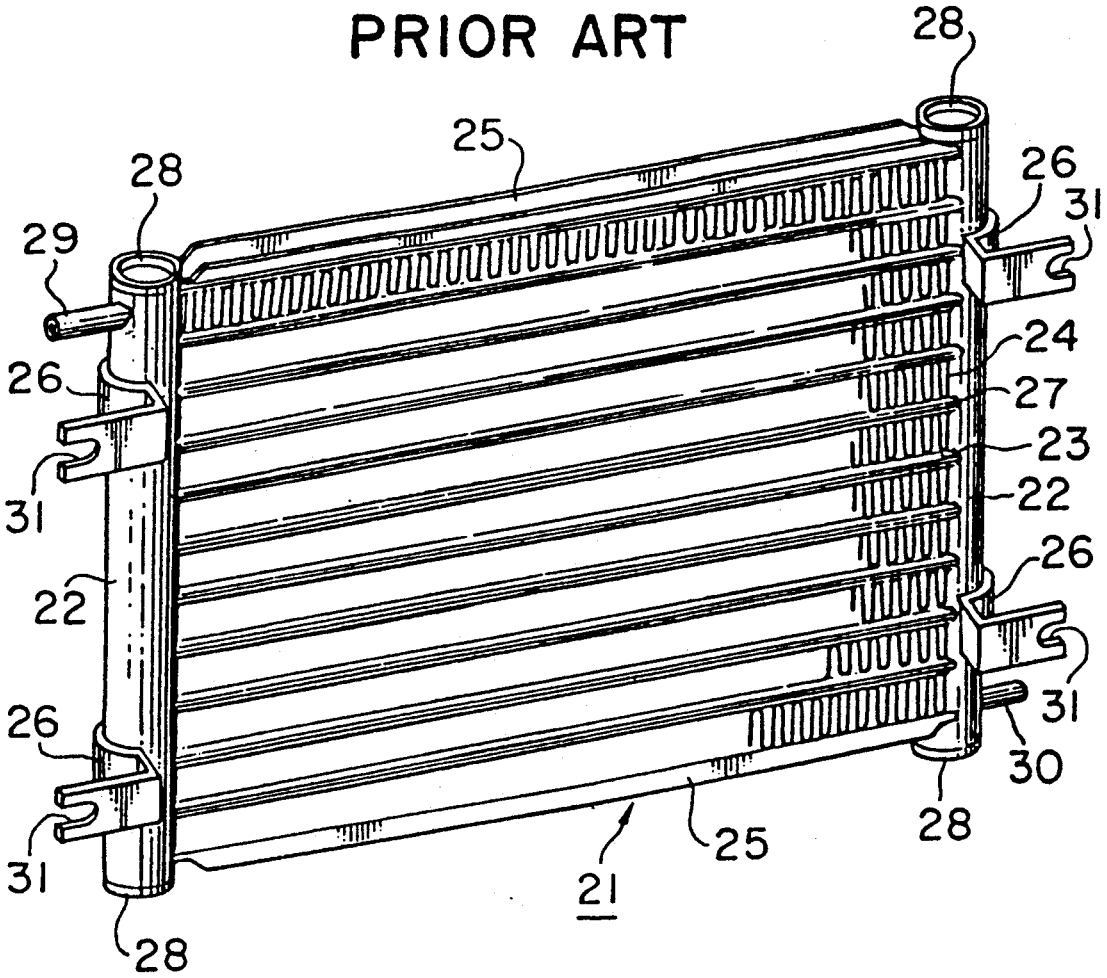
FIG. 1 PRIOR ART
FIG. 1 is a perspective view of a prior art heat exchanger of a conventional automotive air conditioning system.
Figure 2:
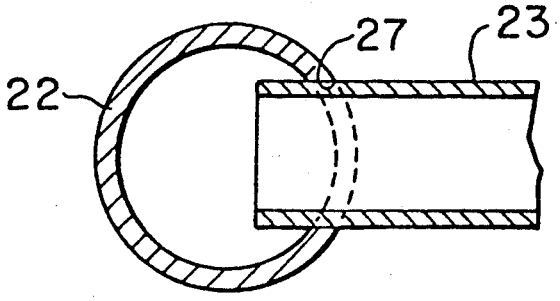
FIG. 2 PRIOR ART
FIG. 2 is an enlarged cross sectional view of the connection between a header pipe and a tube of the heat exchanger shown in FIG. 1.
Figure 3:
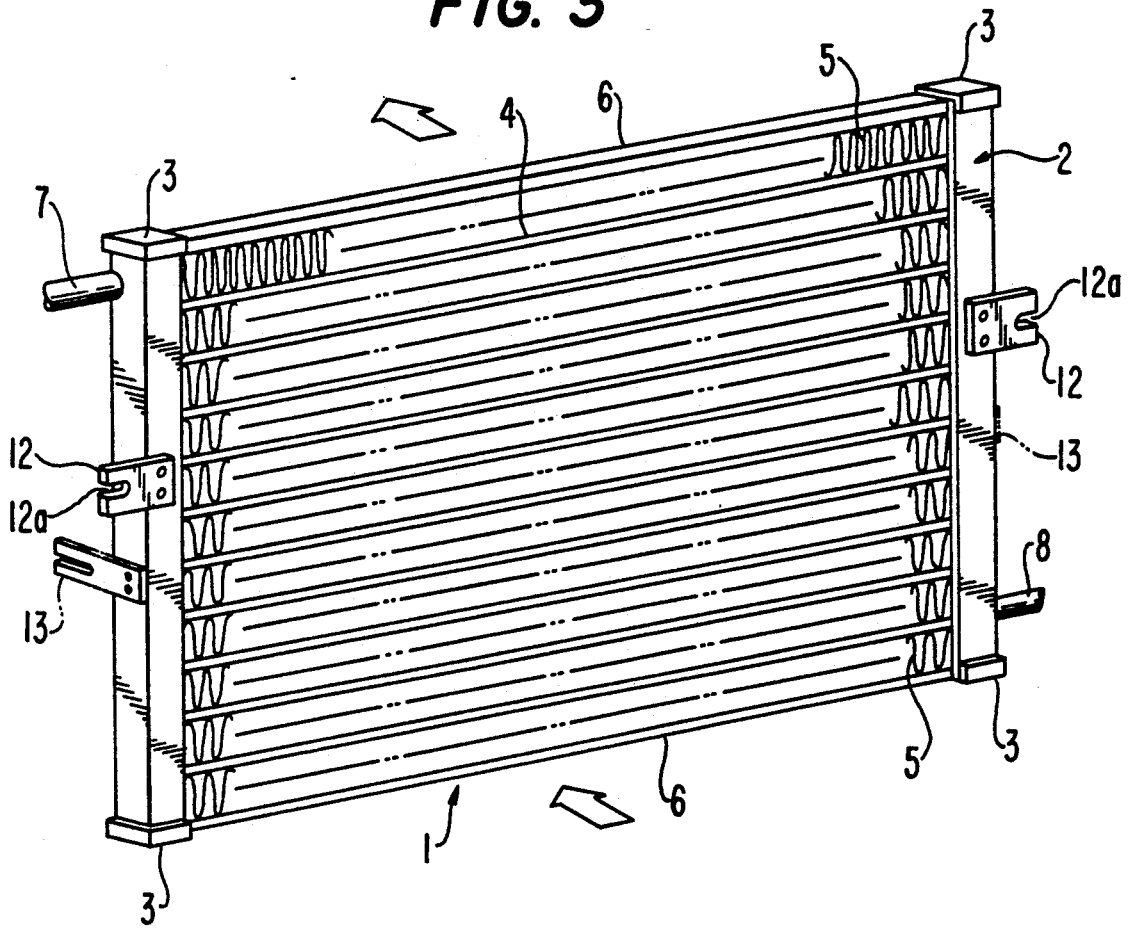
FIG. 3 is a perspective view of a heat exchanger of an automotive air conditioning system according to a first embodiment of the present invention.
Figure 4:
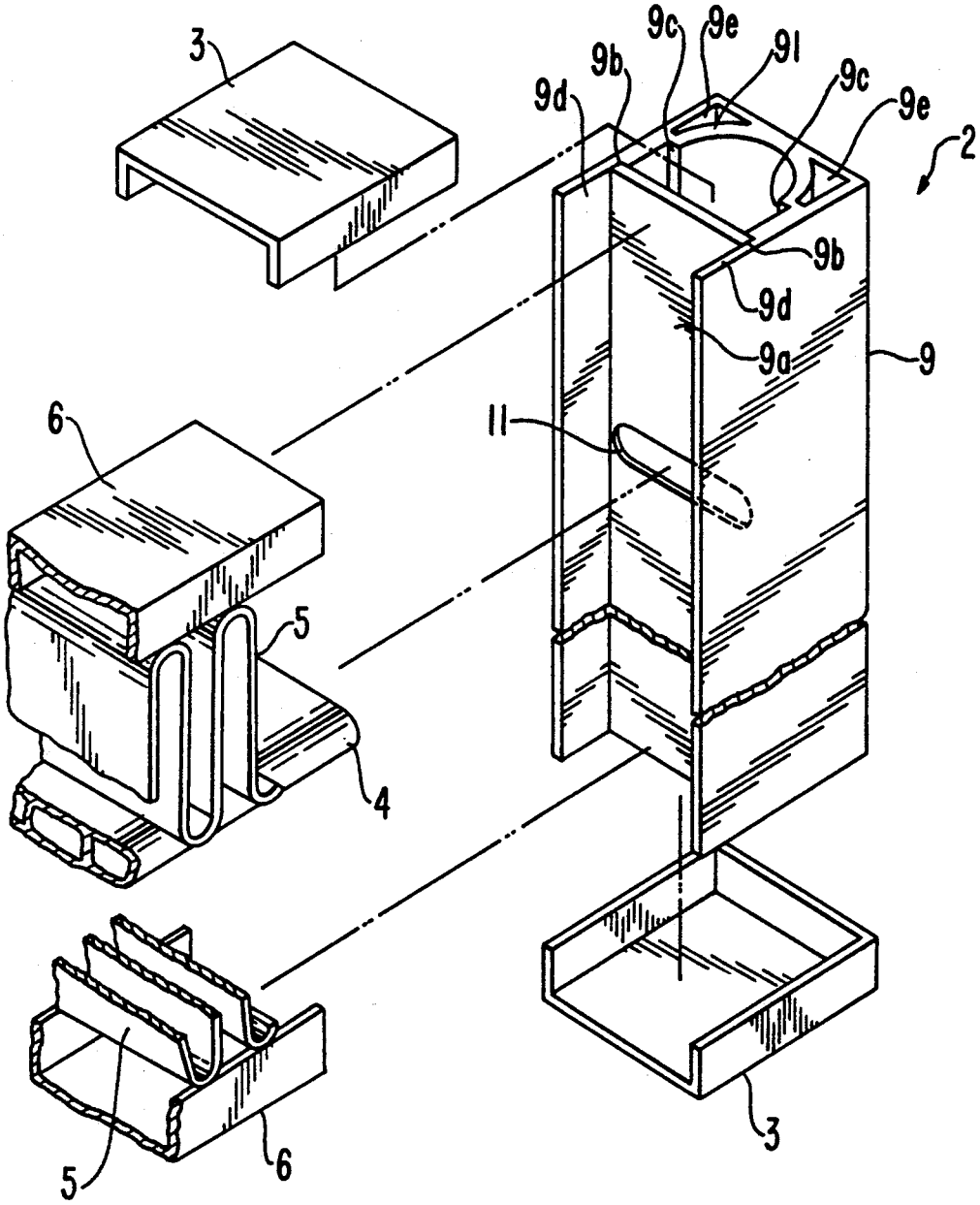
FIG. 4 is a fragmentary exploded perspective view of a part of a header pipe and a tube of the heat exchanger as shown in FIG. 3.

Referring to the drawings, FIGS. 3–6 illustrate a heat exchanger according to a first embodiment of the present invention. In FIG. 3, a heat exchanger 1 has a pair of header pipes 2 extending in parallel relation to each other. Header pipes 2 are closed at both of their end portions by caps 3. A plurality of substantially parallel tubes 4 are disposed between the pair of header pipes 2. The tubes 4 are preferably formed as flat tubes in this embodiment. The flat tubes 4 are connected to the pair of header pipes 2 at their end portions. A plurality of corrugate type radiation fins 5 are provided on the sides of flat tubes 4 and fixed to the flat tubes by, for example, brazing. Reinforcement members 6 are provided on the upper surface of the top radiation fin 5 and the lower surface of the bottom radiation fin 5, respectively. The reinforcement members 6 are fixed to the upper and lower surfaces of the respective radiation fins and the sides of header pipes 2. An inlet tube 7 is connected to the upper portion of one of the header pipes 2, and an outlet tube 8 is connected to the lower portion of the other header pipe. A heat medium (for example, a cooling medium or a brine) is introduced through inlet tube 7, flows through header pipes 2 and flat tubes 4, and flows out of outlet tube 8.

Each header pipe 2 is constructed from a rectangular member 9 and a connecting plate 10. Rectangular member 9 has an inner wall 91 and a U-shaped cross section which defines an opening 9*a*. Inner wall 91 is provided along the inside of rectangular member 9 and is semitubular in cross section. Inner wall 91 extends in the longitudinal direction of the rectangular member. Opening 9*a* extends in the longitudinal direction along one side of the rectangular member.

A pair of step-like portions 9*b* extending in the longitudinal direction of the rectangular member and facing each other are formed on the inner surfaces of the walls defining opening 9*a*. A pair of step-like portions 9*c* extending in the longitudinal direction of the rectangular member and facing each other are formed on the surfaces of the portion connecting the end portions of inner wall 91 and the inner surfaces of rectangular member 9. Spaces 9*e* are defined at the corners of rectangular member 9 by the inner surfaces of the rectangular member and the outer-curved surfaces of inner wall 91, respectively.

Planar plate portions 9*d* extend outward from step-like portions 9*b* and in parallel relation to each other. One of the planar plate portions 9*d* functions as an attachment portion for brackets (described later). On this attachment portion, tapped holes (not shown) are formed on the relatively upper portions of each rectangular member 9. A rectangular member 9 having such a structure can be manufactured by, for example, extrusion molding.

Connecting plate 10 has a plurality of connection holes 11 with a predetermined pitch arranged in the longitudinal direction of the connecting plate. Connecting plate 10 has a width equal to the distance between the inner surfaces of both step-like portions 9*b* and is fitted in the step-like portions along both its edge portions. After being fitted and retained against step-like portions 9*b*, the connecting plate is fixed to rectangular member 9 by, for example, brazing. Connecting plate 10 is preferably a planar plate in cross section.

Figure 5:
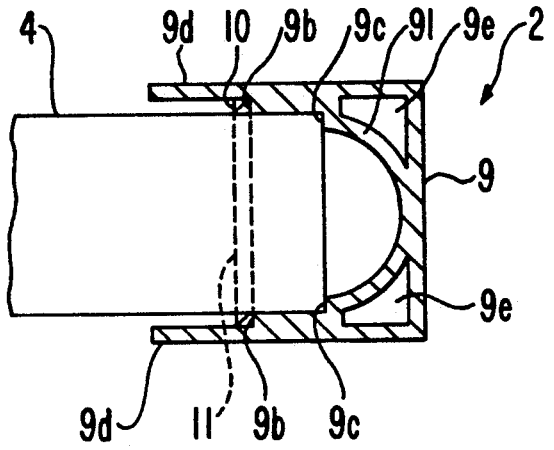
FIG. 5 is a cross sectional view of the connection between a header pipe and a tube of a heat exchanger as shown in FIG. 3.

As shown in FIG. 5, the end portions of tubes 4 are inserted into holes 11 until the end portions of tubes 4 contact the surfaces of step-like portions 9*c* of rectangular member 9. The end portions are fixed to connecting plate 10 and rectangular member 9 by, for example, brazing. Connecting plate 10 may be installed against step-like portions 9*b* of rectangular member 9 after tubes 4 are fixed to the connecting plate. Alternatively, connecting plate 10 may be installed in rectangular member 9 prior to the attachment of tubes 4 to the connecting plate.

Figure 6:
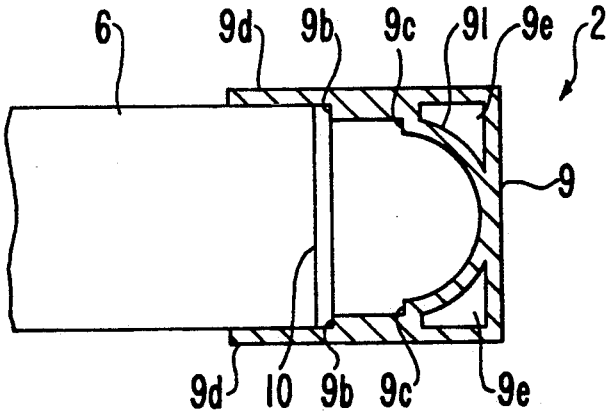
FIG. 6 is a cross sectional view of the connection between a header pipe and a reinforcement member of a heat exchanger as shown in FIG. 3.

Reinforcement members 6 are disposed on the upper and lower surfaces of the respective radiation fins 5. The end portions of reinforcement members 6 contact the surfaces of connecting plate 10, as shown in FIG. 6. In addition, the respective reinforcement members 6 have a width equal to the distance between the inner surfaces of the planar plate portions 9*d*, so that the reinforcement members 6 contact each of the opposing surfaces of the planar plate portions 9*d*. Reinforcement members 6 are securely fixed to fins 5 and connecting plate 10 by, for example, brazing.

Brackets 12 are provided for supporting and attaching the heat exchanger to a structure of an air conditioner, a body of a vehicle or other member. Bracket 12 is preferably formed as a planar plate member in this embodiment. A U-shaped slot 12*a* is formed on one end portion of the bracket. Two through holes (not shown) are formed on the other end portion for attaching the bracket to rectangular member 9. Bracket 12 is attached to attachment portion 9*d* of rectangular member 9 by bolts or rivets (not shown) which are secured into the through holes defined in portions 9*d* of rectangular plate 9. In this embodiment, two further through holes may also formed on the other side of rectangular member 9 at a position corresponding to spaces 9*e*. These additional through holes facilitate the attachment of brackets extending transversely to the heat exchanger (FIG. 3). Two brackets 13 may also be attached to header pipes 2 at the relatively lower portions of the header pipes.

In this embodiment, header pipe 2 is constructed from rectangular member 9 including inner wall 91 and connecting plate 10. The connecting plate having connection holes 11 is a member separate from the rectangular member. Therefore, connecting plate 10 may have a simple shape. As a result, connection holes 11 can be easily processed without using a special jig or tool and without troublesome working. Accordingly, header pipes 2 are manufactured easily and inexpensively. Moreover, since connection holes 11 can be easily formed precisely to a desired shape and at desired positions, insertion and connection of tubes 4 can be easily and efficiently accomplished.

Further, brackets 12 can be easily attached to attachment portion 9*d* of rectangular member 9 since the periphery of a header pipe includes planar sides. Therefore, brackets 12 can be very easily attached to header pipes 2 without any troublesome working. Moreover, various shaped brackets can be employed. This increases the working efficiency in the bracket attachment process and reduces the production cost of the heat exchanger.

In addition, the end portions of the tubes are connected (preferably by brazing) to the header pipe 2 at two discrete positions; namely, step-like portions 9*c* and through holes 11. The reinforcement members are disposed on the upper and lower surfaces of the respective radiation fins and connected to the connecting plate (preferably by brazing) after the end portions of the reinforcement members contact the outer surfaces of the connecting plates. As a result, the overall strength of a heat exchanger is efficiently improved.

Figure 7:
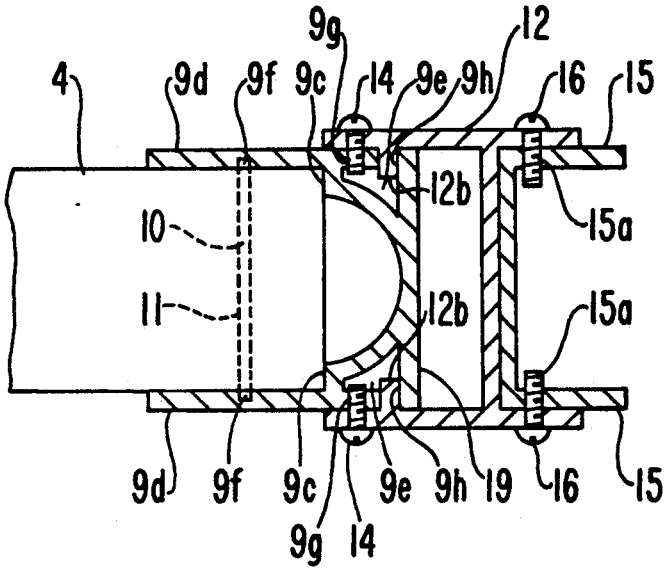
FIG. 7 is a cross sectional view of the connection between a header pipe and a tube of a heat exchanger according to a second embodiment of the present invention.

With reference FIG. 7, the connection between a header pipe and a tube in a heat exchanger according to a second embodiment of this invention is shown. Grooves 9*f* are formed on the inner surfaces of planar plate portions 9*d* for receiving connecting plate 10, instead of step-like portions 9*b*. Connecting plate 10 is inserted into and securely disposed in grooves 9*f*. The distance between the bottom end surfaces of grooves 9*f* is substantially equal to the width of connecting plate 10. Two through holes 9*g* are formed on the side surfaces of rectangular member 9. Bolts 14 are preferably screwed into the through holes through one end of bracket 12 until the end portions of bolts 14 are inserted into the interiors of spaces 9*e*. Of course other fasteners may alternatively be used. Two through holes 15*a* are formed on the side surfaces of a frame 15 of a car body. Bolts 16 or other fasteners are secured into the through holes through one end of frame 16. In this way, the heat exchanger is securely fixed to the car body or other structure through the bracket. As shown in FIG. 7, protrusion portions 12*b* of bracket 12 are disposed in grooves 9*h* extending in the longitudinal direction of header pipe 2. As a result, bracket 12 can be vertically adjusted along grooves 9*h*.

Figure 8:
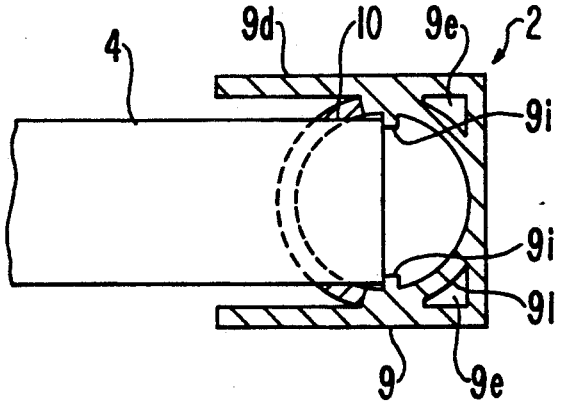
FIG. 8 is a cross sectional view of the connection between a header pipe and a tube of a heat exchanger according to a third embodiment of the present invention.
Figure 9:
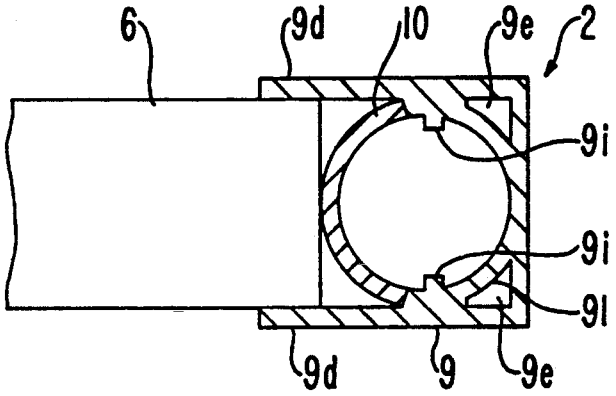
FIG. 9 is a cross sectional view of the connection between a header pipe and a reinforcement member of a heat exchanger as shown in FIG. 8.
Figure 10:
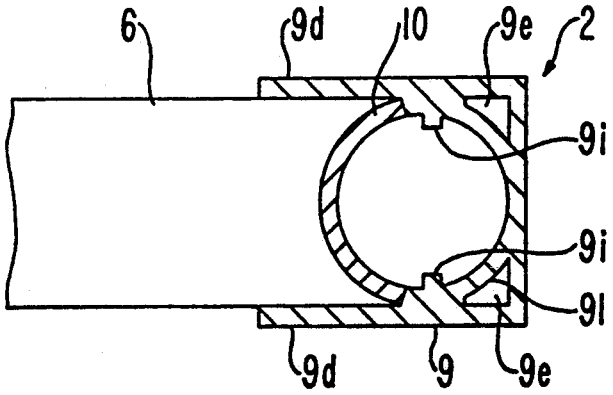
FIG. 10 is a cross sectional view of the connection between a header pipe and another reinforcement member of a heat exchanger as shown in FIG. 8.

With reference to FIGS. 8–10, the connection between a header pipe and a tube in a heat exchanger according to a third embodiment of this invention is shown.

In this third embodiment, a pair of projecting portions 9*i* are formed on the surfaces of the portion connecting the end portions of inner wall 9*l* and the inner surfaces of rectangular member 9. Projecting portions 9*i* are formed to face each other and extend in the longitudinal direction of rectangular member 9. Connecting plate 10 is preferably curved in its cross section so that its curvature substantially matches the curvature of the curved portion of inner wall 9. The end portions of tubes 4 are inserted into connection holes 11 and fixed to the side surfaces of projections 9*i* by, for example, brazing. The end portions of reinforcement members 6 are fixed to the top of the curved portion of connecting plate 10 by brazing as shown in FIG. 9. In FIG. 10, the end portions of reinforcement members 6 are formed so that its ends substantially match the curvature of the connecting plate 10. In this arrangement, the ends of reinforcement members 6 are fixed to connecting plate 10 along its peripheral edge surface by, for example, brazing.

This invention has been described in detail in connection with the preferred embodiments. The preferred embodiments, however, are for purposes of illustration and are not intended to be restrictive. It will be understood by those skilled in the art, that variations and modifications can be easily made within the scope of this invention, as defined by the appended claims.

I claim:

1. In a heat exchanger including a pair of substantially parallel header pipes and a plurality of substantially parallel tubes disposed between said pair of header pipes, each said tube defining a pair of end portions connected to said pair of header pipes, said header pipes and tubes forming a path for the passage of a heat medium, the improvement comprising:

each of said pair of header pipes comprising a rectangular member having an opening formed on a side thereof and extending in the longitudinal direction of said rectangular member, and a connecting plate disposed in said opening, said connecting plate having a plurality of holes for inserting said end portions of said tubes therein to connect said tubes to each of said pair of header pipes; and an inner wall dividing said header pipe into a first portion forming a part of said path for the heat medium and a second portion for enabling the use of fasteners to connect a bracket thereto.

2. A heat exchanger according to claim 1 further comprising a plurality of fins provided along sides of said tubes.

3. A heat exchanger according to claim 2 further comprising a pair of reinforcement members provided along sides of each of the top and bottom fins.

4. A heat exchanger according to claim 3 wherein said respective reinforcement members have a width which substantially equals the distance between the inner surfaces of said rectangular member in said opening.

5. A heat exchanger according to claim 1 wherein said tubes are flat tubes.

6. A heat exchanger according to claim 1 further comprising an additional inner wall formed along the inside of said rectangular member.

7. A heat exchanger according to claim 6 wherein said inner wall has a curved cross sectional shape and wherein said connecting plate has a curved cross sectional shape with a curvature which substantially matches the curvature of said inner wall in said rectangular member.

8. A heat exchanger according to claim 6 wherein said rectangular member has a pair of step-like portions at a general position where the end portions of said inner wall and the inside surface of said rectangular member are connected for receiving the end portions of said tubes.

9. A heat exchanger according to claim 8 wherein additional step-like portions are formed by the end portions of said inner wall for engaging side edges of said connecting plate.

10. A heat exchanger according to claim 1 wherein said rectangular member has a pair of step-like portions in said opening for engaging a pair of side edges of said connecting plate.

11. A heat exchanger according to claim 1 wherein said connecting plate is matingly received and fitted in said opening of said rectangular member.

12. A heat exchanger according to claim 1 wherein said connecting plate is a planar plate member.

13. In a heat exchanger including a pair of substantially parallel header pipes and a plurality of substantially parallel tubes disposed between said pair of header pipes, each said tube defining a pair of end portions connected to said pair of header pipes, the improvement comprising:

each of said pair of header pipes comprising a rectangular member having an opening formed on a side thereof and extending in the longitudinal direction of said rectangular member, and a connecting plate disposed in said opening, said connecting plate having a plurality of holes for inserting said end portions of said tubes therein to connect said tubes to each of said pair of header pipes;

a plurality of fins provided along sides of said tubes; and a pair of reinforcement members provided along sides of each of the top and bottom fins, wherein said respective reinforcement members provided along sides of each of the top and bottom fins have a width which substantially equals the distance between the inner surfaces of said rectangular member in said opening and wherein said reinforcement members contact the side surfaces of said connecting plates at their end portions and contact the inner surfaces of said rectangular member in said opening along its side surfaces.

14. In a heat exchanger including a pair of substantially parallel header pipes and a plurality of substantially parallel tubes disposed between said pair of header pipes, each said tube defining a pair of end portions connected to said pair of header pipes, the improvement comprising:

each of said pair of header pipes comprising a rectangular member having an opening formed on a side thereof and extending in the longitudinal direction of said rectangular member, and a connecting plate disposed in said opening, said connecting plate having a plurality of holes for inserting said end portions of said tubes therein to connect said tubes to each of said pair of header pipes;

a plurality of fins provided along sides of said tubes; and a pair of reinforcement members provided along sides of each of the top and bottom fins, wherein said reinforcement members contact the side surfaces of said connecting plates at their end portions and contact the inner surfaces of said rectangular member in said opening along its side surfaces.

15. A heat exchanger comprising:

a plurality of header pipes, each header pipe including an elongated channel member defining an opening along one side and a connecting plate disposed in said opening, said channel member and said connecting plate being interconnected to form a header pipe having a generally rectangular cross section, and said connecting plates defining a plurality of spaced apart holes along its length, wherein said channel member further includes an additional inner wall which divides said header pipe into a first portion forming a part of said path for the heat medium and second portion for enabling the use of fasteners to connect said bracket thereto;

a plurality of heat exchange tubes each having a tubular construction and a plurality of ends, each said end of each heat exchange tube being received within a hole defined in said connecting plate to interconnect said header pipes together, said header pipes and tubes forming a path for the passage of a heat medium;

an inlet tube interconnected with one of the header pipes to enable the heat medium to enter the heat exchanger; and an outlet tube interconnected with one of the header pipes to enable the heat medium to exit the heat exchanger.

16. A heat exchanger according to claim 15 wherein said channel member further includes a plurality of first stops and wherein said connecting plate engages said first stops.

17. A heat exchanger according to claim 16 wherein said channel member further includes a plurality of second stops spaced inwardly of said first stops relative to said channel member and wherein said ends of said heat exchanger tubes engage said second stops.

18. A heat exchanger according to claim 15 wherein said channel member further includes a plurality of spaced apart, opposed grooves which receive said connecting plate in said opening of said channel member.

19. A heat exchanger according to claim 15 wherein said heat exchanger further includes at least one bracket member for mounting said heat exchanger, wherein said channel member includes a pair of substantially parallel side walls each having a free end, and wherein said connecting plate is secured to said channel member inside of at least one of said free ends of said side walls so that said at least one side wall includes a portion which extends beyond the tubular construction of said header pipe for enabling the use of fasteners to connect said bracket thereto.

20. A heat exchanger according to claim 15 wherein said channel member further defines a slot in at least one of said side walls to receive and support a portion of said bracket.

21. A method of making a heat exchanger having a fluid flow path therein, said method comprising the steps of:

forming a plurality of channel members such that each has a generally rectangular configuration and defines a longitudinal opening along one side thereof;

forming an inner wall in at least one of said channel members such that said at least one channel member is divided into a first portion forming a part of the fluid flow path and a second portion for enabling the use of fasteners to connect a bracket thereto;

forming a plurality of connecting plates;

forming a plurality of spaced apart holes along the length of each of said connecting plates;

forming a plurality of heat exchange tubes each having a pair of ends;

inserting each end of each heat exchange tube into one of said holes defined in one of said connecting plates; and inserting each of said connecting plates into one of said openings defined by said channel members such that each assembled connecting plate and channel member define a rectangular header pipe.

22. A heat exchanger according to claim 1, said inner wall having a semitubular cross section.

23. A heat exchanger according to claim 15, said inner wall having a semitubular cross section.

24. A heat exchanger according to claim 21, said step of forming an inner wall further comprises the step of forming an inner wall with a semitubular cross section.

* * * * *